US006636796B2

(12) United States Patent
Kolmanovsky et al.

(10) Patent No.: US 6,636,796 B2
(45) Date of Patent: Oct. 21, 2003

(54) METHOD AND SYSTEM FOR ENGINE AIR-CHARGE ESTIMATION

(75) Inventors: Ilya V Kolmanovsky, Ypsilanti, MI (US); Alexander Anatoljevich Stotsky, Gothenburg (SE)

(73) Assignee: Ford Global Technologies, Inc., Dearborn, MI (US)

( * ) Notice: Subject to any disclaimer, the term of this patent is extended or adjusted under 35 U.S.C. 154(b) by 241 days.

(21) Appl. No.: 09/769,800

(22) Filed: Jan. 25, 2001

(65) Prior Publication Data

US 2002/0133286 A1 Sep. 19, 2002

(51) Int. Cl.[7] ..... F02D 41/18
(52) U.S. Cl. ..... 701/104; 73/118.2; 123/480
(58) Field of Search ..... 701/102, 104, 701/114, 115; 123/480, 488; 73/118.2

(56) References Cited

U.S. PATENT DOCUMENTS 5,497,329 A * 3/1996 Tang ..... 701/104
5,555,870 A * 9/1996 Asano ..... 123/480
5,889,204 A 3/1999 Scherer et al.
6,363,316 B1 * 3/2002 Soliman et al. ..... 701/104

OTHER PUBLICATIONS

J.A. Cook et al, "Engine Control", IEEE Control Handbook, CRC Press, Inc., 1996, pp. 1261–1274.

J.W. Grizzle et al, "Improved Cylinder Air Charge Estimation For Transient Air Fuel Ratio Control", Proceedings of 1994 American Control Conference, Baltimore, Md., Jun. 1994, pp. 1568–1573.

M. Jankovic et al, "Air–charge Estimation and Prediction in Spark Ignition Internal Combustion Engines", Proceedings of 1999 American Control Conference, San Diego, CA.

Y.–W. Kim et al, "Automotive Engine Diagnosis and Control Via Nonlinear Estimation", IEEE Control Systems Magazine, Oct. 1998, pp. 84–99.

T.–C. Tseng et al, "An Adaptive Air–Fuel Ratio Controller for SI Engine Throttle Transients", SAE Paper 1999–01–0552.

Hendricks, E. et al., "Alternative Observers for SI Engine Air/Fuel Ratio Control", Proceedings of the 35$^{th}$ IEEE Conference on Decision and Control, Kobe, Japan, Dec. 11–13, 1996, Dec. 11, 1996, pp. 2806–2811, IEEE, New York, NY, USA.

* cited by examiner

*Primary Examiner*—Andrew M. Dolinar
(74) *Attorney, Agent, or Firm*—Julia Voutyras; Allen J. Lippa

(57) ABSTRACT

The air flow into an engine is estimated via a speed-density calculation wherein the volumetric efficiency is estimated on-line. There are three interconnected observers in the estimation scheme. The first observer estimates the flow through the throttle based on the signal from a mass air flow sensor (MAF). The second observer estimates the intake manifold pressure using the ideal gas law and the signal from a intake manifold absolute pressure sensor (MAP). The third observer estimates the volumetric efficiency and provides an estimate of the air flow into the engine.

26 Claims, 3 Drawing Sheets

METHOD AND SYSTEM FOR ENGINE AIR-CHARGE ESTIMATION

BACKGROUND OF THE INVENTION

1. Field of the Invention

This invention relates to fuel control systems and, more particularly, to an improved method of estimating the air flow into an engine.

2. Background Art

An air-charge estimation algorithm is an important part of a spark-ignition engine management system. The estimate of the air flow into the engine is used to calculate the amount of fuel that needs to be injected so that the air-to-fuel ratio is kept close to the stoichiometric value for optimum Three Way Catalyst (TWC) performance.

In diesel engines, the air-to-fuel ratio must be maintained above a specified threshold to avoid the generation of visible smoke. At tip-ins, the EGR valve is typically closed and the control system calculates the amount of fuel that can be injected so that the air-to-fuel ratio stays at the threshold value. Inaccurate air-to-fuel ratio estimation in transients may result in either visible smoke emissions or detrimental consequences for torque response (increased turbo-lag).

A basic air-charge estimation algorithm relies on a speed-density equation that for a four cylinder engine has the form, $$m_e = \eta_v \frac{n_e}{2} V_d \frac{p}{RT},$$

where:

$m_e$ is the mean-value of the flow into the engine, $n_e$ is the engine speed (in rps), $\eta_v$ is the volumetric efficiency, $\rho$ is the intake manifold pressure, $V_d$ is the total displaced cylinder volume, T is the intake manifold temperature, and R is the gas constant.

The volumetric efficiency map is typically calibrated on an engine dynamometer and stored in lookup tables as a function of engine operating conditions. In a conventional approach for a Variable Valve Timing (VVT) engine, $\eta_v$ would be a function of valve timing, obtained as a result of elaborate calibration. The intake manifold pressure may be either measured by a pressure sensor (MAP) or, if there is no MAP sensor, estimated based on the intake manifold isothermic equation:

$$\dot{p} = \frac{RT}{V_{IM}}(m_{th} - m_e),$$

where $m_{th}$ is the flow through the engine throttle (measured by a MAF sensor) and $V_{IM}$ is the intake manifold volume. This continuous time equation needs to be discretized for the implementation as follows:

$$p_{\text{cal}}(k+1) = p_{\text{cal}}(k) + \Delta T \frac{RT}{V_{IM}}(m_{th}(k) - m_e(k)), \tag{1}$$

where $\Delta T$, is the sampling rate, $m_{th}(k)$ is the measured or estimated throttle flow and $m_e(k)$ is the estimate of the flow into the engine based on the current measurement or estimate of the intake manifold pressure $p_{cal}(k)$. The variable $p_{cal}$ may be referred to as the modeled, estimated, or observed pressure. As is explained in more detail below, more elaborate schemes for air-charge estimation use the model in Equation (1) even if MAP sensor is available because useful information can be extracted from the error between the modeled pressure $P_{cal}$ and the measured pressure p.

More elaborate schemes used in spark-ignition (SI) engines perform the following functions: compensate for the dynamic lag in the MAF sensor with a lead filter, see for example J. A. Cook, J. W. Grizzle, J. Sun, "Engine Control", in IEEE CONTROL HANDBOOK, CRC Press, Inc. 1996, pp 1261–1274; and J. W. Grizzle, J. Cook, W. Milam, "Improved Cylinder Air Charge Estimation for Transient Air Fuel Ratio Control", PROCEEDINGS OF 1994 AMERICAN CONTROL CONFERENCE, Baltimore, Md., June 1994, pp. 1568–1573; filter out the noise in the pressure and throttle flow measurements and adapt on-line the volumetric efficiency from the deviation between the actual pressure measurement and modeled pressure, see for example Y. W. Kim, G. Rizzoni, and V. Utkin, "Automotive Engine Diagnosis and Control via Nonlinear Estimation", IEEE CONTROL SYSTEMS MAGAZINE, October 1998, pp. 84–99; and T. C. Tseng, and W. K. Cheng, "An Adaptive Air-Fuel Ratio Controller for SI Engine Throttle Transients", SAE PAPER 1999-01-0552. The adaptation is needed to compensate for engine aging as well as for other uncertainties (in transient operation). For engines without an electronic throttle, an estimate of the flow into the engine needs to be known several events in advance. In these cases, a predictive algorithm for the throttle position may be employed. See, for example, M. Jankovic, S. Magner, "Air-Charge Estimation and Prediction in Spark Ignition Internal Combustion Engines", PROCEEDINGS OF 1999 AMERICAN CONTROL CONFERENCE, San Diego, Calif.

In a typical embodiment of the schemes in the prior art, two low pass filters, on intake manifold pressure and throttle flow, may be employed to filter out the noise and periodic signal oscillation at the engine firing frequency. One dynamic filter would be used as a lead filter to speed up the dynamics of the MAF sensor. One dynamic filter would be used for the intake manifold pressure model and one integrator would be utilized to adjust the estimate of the volumetric efficiency as an integral of the error between the measured and estimated intake manifold pressure. This is a total of five filters.

SUMMARY OF THE INVENTION

It is an object of the present invention to provide an improved air-charge estimation algorithm.

It is another object of the present invention to provide an improved air-charge estimation algorithm that enables tighter air-to-fuel ratio control in SI engines.

It is a further object of the present invention is to provide an improved air-charge estimation algorithm that enables least turbo-lag to be achieved without generating visible smoke.

In accordance with the present invention, a method and system for estimating air flow into an engine is proposed that accomplishes the above steps of MAF sensor speedup, noise filtering and on-line volumetric efficiency estimation but uses only three dynamic filters. This reduces the implementation complexity of the air charge algorithm.

The mechanism for on-line volumetric efficiency estimation provided in the present invention is of differential type as opposed to the integral type algorithms employed in Kim and Tseng. The main advantage of the differential type algorithm of the present invention is that the correct estimate of the flow into the engine is provided even during fast changes in engine operation. In particular, in SI engines with VVT, valve timing changes would have a substantial influence on the air-charge. The proposed algorithm estimates the air-charge accurately even during fast VVT transitions, relying on no (or reduced amount of) information about VVT position or air-charge dependence on valve timing. Integral-type algorithms that adapt the volumetric efficiency are too slow to adjust to such rapid changes in the engine operation. Because no detailed information about the dependence of the air-charge on valve timing is required, the calibration complexity is reduced in the present invention.

More particularly, in accordance with the present invention, the flow into the engine is estimated via a speed-density calculation wherein the volumetric efficiency is estimated on-line. There are three interconnected observers in the estimation scheme. An observer is an algorithm for estimating the state of a parameter in a system from output measurements. The first observer estimates the flow through the throttle based on the signal from a mass air flow sensor (MAF). It essentially acts as a compensator for the MAF sensor dynamics. The second observer estimates the intake manifold pressure using the ideal gas law and the signal from an intake manifold absolute pressure (MAP) sensor. This second observer acts as a filter for the noise and periodic oscillations at engine firing frequency contained in the MAP sensor signal and the MAF signals. The third observer estimates the volumetric efficiency and provides an estimate of the air flow into the engine.

DETAILED DESCRIPTION OF THE PREFERRED EMBODIMENT(S)

Figure 1:
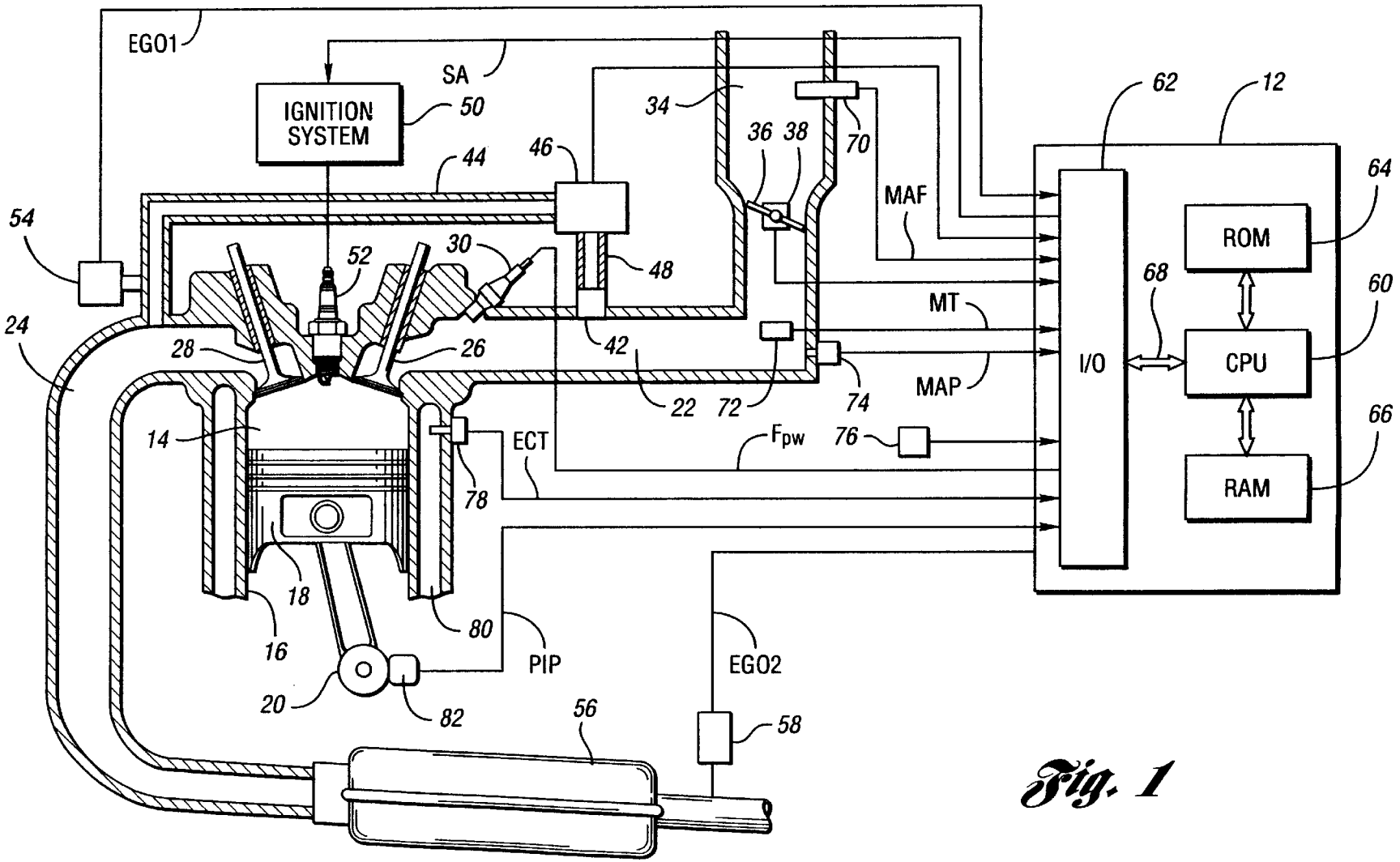
FIG. 1 is a schematic block diagram of an engine control system for implementing the present invention.

Referring now to the drawing and initially to FIG. 1, internal combustion engine 10, comprising a plurality of cylinders, one cylinder of which is shown in FIG. 1, is controlled by electronic engine controller 12. Engine 10 includes combustion chamber 14 and cylinder walls 16 with piston 18 positioned therein and connected to crankshaft 20. Combustion chamber 14 is shown communicating with intake manifold 22 and exhaust manifold 24 via respective intake valve 26 and exhaust valve 28. Intake manifold 22 is also shown having fuel injector 30 coupled thereto for delivering liquid fuel in proportion to the pulse width of signal $F_{PW}$ from controller 12. Both fuel quantity, controlled by signal $F_{PW}$ and injection timing are adjustable. Fuel is delivered to fuel injector 30 by a conventional fuel system (not shown) including a fuel tank, fuel pump, and fuel rail. Alternatively, the engine may be configured such that the fuel is injected directly into the cylinder of the engine, which is known to those skilled in the art as a direct injection engine. Intake manifold 22 is shown communicating with throttle body 34 via throttle plate 36. Throttle position sensor 38 measures position of throttle plate 36. Exhaust manifold 24 is shown coupled to exhaust gas recirculation valve 42 via exhaust gas recirculation tube 44 having exhaust gas flow sensor 46 therein for measuring an exhaust gas flow quantity. Exhaust gas recirculation valve 42 is also coupled to intake manifold 22 via orifice tube 48.

Conventional distributorless ignition system 50 provides ignition spark to combustion chamber 14 via spark plug 52 in response to controller 12. Two-state exhaust gas oxygen sensor 54 is shown coupled to exhaust manifold 24 upstream of catalytic converter 56. Two-state exhaust gas oxygen sensor 58 is shown coupled to exhaust manifold 24 downstream of catalytic converter 56. Sensors 54 and 56 provide signals EGO1 and EGO2, respectively, to controller 12 which may convert these signal into two-state signals, one state indicating exhaust gases are rich of a reference air/fuel ratio and the other state indicating exhaust gases are lean of the reference air/fuel ratio.

Controller 12 is shown in FIG. 1 as a conventional microcomputer including: microprocessor unit 60, input/output ports 62, read-only memory 64, random access memory 66, and a conventional data bus 68. Controller 12 is shown receiving various signals from sensors coupled to engine 10, in addition to those signals previously discussed, including: a mass air flow (MAF) from mass flow sensor 70 coupled to intake manifold 22; a measurement of manifold pressure (MAP) from pressure sensor 72 before throttle 38; an intake manifold temperature (MT) signal from temperature sensor 74; an engine speed signal (RPM) from engine speed sensor 76; engine coolant temperature (ECT) from temperature sensor 78 coupled to cooling sleeve 80; and a profile ignition pickup (PIP) signal from Hall effect sensor 82 coupled to crankshaft 20. Preferably, engine speed sensor 76 produces a predetermined number of equally spaced pulses every revolution of the crankshaft.

It is well known that the MAF sensor 70 is slow compared to the MAP sensor 72. A typical MAF sensor operates by passing a current through the hot wire so that its temperature is regulated to a desired value; the current value required to sustain a desired temperature while being cooled by the flow is then a measure of the mass flow rate. Clearly, this regulation introduces additional sensor dynamics that can be modeled by the following equation:

$$\dot{m}_{MAF} = -\frac{1}{\tau_{MAF}}(m_{MAF} - m_{th}), \tag{2}$$

where $\tau_{MAF}$, is the time constant of the MAF sensor, $m_{th}$ is the flow through the throttle, and $m_{MAF}$ is the MAF sensor reading. The observer that estimates the flow through the throttle, $m_{MAF}$ using the output of MAF sensor, $m_{th}$, has the following form $$\dot{\varepsilon}_f = -\gamma_f \varepsilon_f \frac{\gamma_f}{\tau} m_{MAF} + \gamma_f^2 m_{MAF}, \tag{3}$$

$$m_{th} = \tau_{MAF}(\gamma_f m_{MAF} - \varepsilon_f),$$

where $\gamma_f > 0$. Note that $\gamma_f > 1/\tau_{MAF}$. Although this observer action is similar to a lead filter proposed in Cook and Grizzle that essentially speeds up MAF sensor dynamics, its algorithmic embodiment as proposed here is different.

While the MAP sensor 64 is fast, it produces noisy measurements. The noise is not only the electrical noise added to the analog sensor readings and in the process of A/D conversion, but also due to the periodic oscillation of the intake manifold pressure at the engine firing frequency. This noise can be filtered out by means of a low-pass filter. However, low-pass filters introduce a phase lag. Since the air flow into the engine is estimated on the basis of the intake manifold pressure (see the speed-density equation below), an excessive phase lag is undesirable because in transients it may lead to incorrect amount of fuel being injected and, hence, loss of TWC efficiency. To avoid an excessive phase lag, an observer that combines an intake manifold pressure model (based on the ideal gas law) and a low-pass filter can be developed as follows:

$$\dot{p}_{\text{cal}} = \frac{RT}{V_{IM}}(m_{th} - m_e) - \gamma_p(p_{\text{cal}} - p_{MAP}), \tag{4}$$

where $P_{cal}$ is the estimated (observed) intake manifold pressure, $P_{MAP}$ is the MAP sensor reading, R is the gas constant, T is the intake manifold temperature, $V_{IM}$ is the intake manifold volume, $m_{th}$ is computed via (3) and $m_e$ is the estimate of the flow into engine, which will be defined hereinafter. Note that the periodic oscillations in the $m_{th}$ signal at the engine firing frequency will also be filtered out by the observer (4).

The flow into the engine can be calculated on the basis of a well-known speed-density equation. For a four cylinder engine, $$m_e = \eta_v \frac{n_e}{2} V_d \frac{p}{RT}, \tag{5}$$

where $m_e$ is the mean-value of the flow into the engine, $n_e$ is the engine speed (in rps), $\eta_v$ is the volumetric efficiency, p is the intake manifold pressure, and $V_d$ is the total displaced cylinder volume. The major obstacle to using (5) to calculate the engine flow is an uncertainty in the volumetric efficiency. Very frequently, the values of the volumetric efficiency are calibrated on the engine test bench under steady-state conditions and "room temperature" ambient conditions. Variations in temperature cause errors in the volumetric efficiency estimate. In the estimation algorithm of the present invention, the volumetric efficiency is estimated on-line from the intake manifold pressure and mass air flow through the throttle measurements. This algorithm is of differential type and allows air charge estimation even during rapid changes in the engine operation (such as a change in the valve timing effected by a VCT mechanism).

The volumetric efficiency is modeled as a sum of two terms. The first term is known (e.g., the initial calibration) while the second term needs to be estimated:

$$\eta_v = \eta_{vk} + \Delta\eta_v. \tag{6}$$

where $\eta_{vk}$, is the known term and $\Delta\eta_v$ is an unknown term (or an error) that needs to be estimated. It is preferable, though not required, to have an accurate map for $\eta_{vk}$. In particular, $\eta_{vk}$ may be stored in a table as a function of engine speed, VVT position, and other engine operating conditions. Then, the speed-density calculation can be rewritten as follows $$m_e = \eta_{vk} \frac{n_e}{2} V_d \frac{p}{RT} + \Delta\eta_v \frac{n_e}{2} V_d \frac{p}{RT}. \tag{7}$$

Differentiating the ideal gas law under the isothermic (constant intake manifold temperature) assumption, the following is obtained:

$$\dot{p} = \frac{RT}{V_{IM}}(m_{th} - m_e). \tag{8}$$

Substituting (7) into (8) the following is obtained:

$$\dot{p} = \eta_{vk} \frac{n_e}{2} V_d \frac{p}{V_{IM}} - \Delta\eta_v \frac{n_e}{2} V_d \frac{p}{V_{IM}} + \frac{RT}{V_{IM}} m_{th}. \tag{9}$$

Now the following observation problem arises. By measuring $$p, \eta_{vk} \frac{n_e}{2} V_d \frac{p}{V_{IM}} \text{ and } \frac{RT}{V_{IM}} m_{th},$$

it is necessary to estimate $$\Delta\eta_v \frac{n_e}{2} V_d \frac{p}{V_{IM}}.$$

The flow into the engine can be estimated as $$m_e = \eta_{vk} \frac{n_e}{2} V_d \frac{p_{\text{cal}}}{RT} + (\varepsilon - \gamma_p p_{\text{cal}}) \frac{V_{IM}}{RT}, \tag{10}$$

where $\in$ is adjusted as follows:

$$\dot{\varepsilon} = -\gamma\varepsilon - \gamma\eta_{vk} \frac{n_e}{2} V_d \frac{p_{\text{cal}}}{V_{IM}} m_{th} + \gamma^2 p_{\text{cal}}. \tag{11}$$

Note that the inputs to the observer (10), (11) are $m_{th}$ which is given by (3) and $P_{cal}$ which is given by (4).

Figure 2:
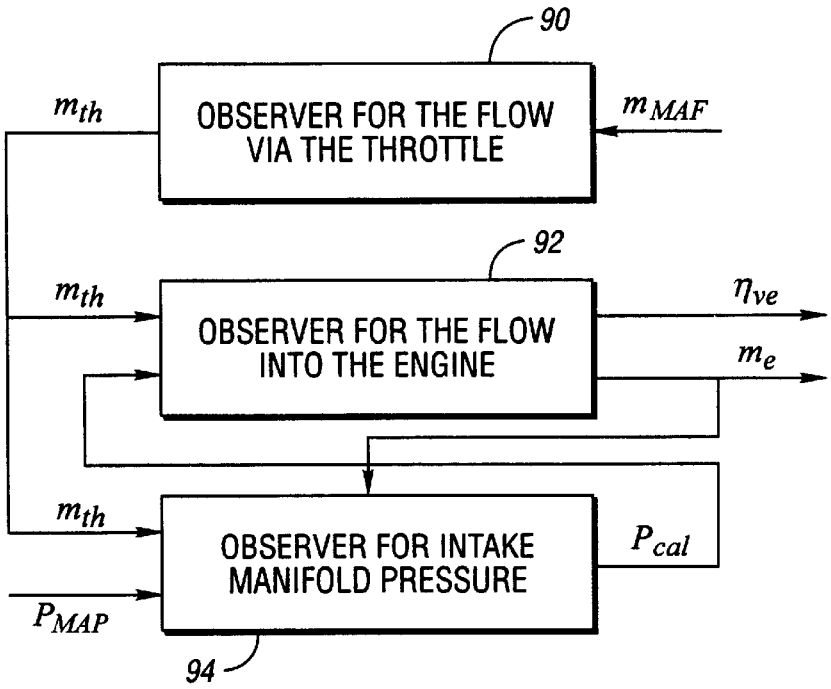
FIG. 2 is a flow diagram showing the interaction of three observers for estimating air flow in the engine in accordance with the method of the present invention.

To summarize, the overall scheme that combines the three observers takes the following form as depicted in FIG. 2. The throttle flow observer 90 is expressed as:

$$\begin{aligned} \dot{\varepsilon}_f &= -\gamma_f \varepsilon_f - \frac{\gamma_f}{\tau_{MAF}} m_{MAF} + \gamma_f^2 m_{MAF} \\ m_{th} &= \tau_{MAF}(\gamma_f m_{MAF} - \varepsilon_f) \end{aligned} \tag{12}$$

The intake manifold pressure observer 94, based on the ideal gas law is as follows:

$$\dot{P}_{\text{cal}} = \frac{RT}{V_{IM}}(m_{th} - m_e) - \gamma_p(p_{\text{cal}} - p_{MAP}) \tag{13}$$

The engine flow observer 92 using the estimation of the volumetric efficiency is as follows:

$$\begin{aligned} m_e &= \eta_{vk} \frac{n_e}{2} V_d \frac{p_{\text{cal}}}{RT} + (\varepsilon - \gamma_p p_{\text{cal}}) \frac{V_{IM}}{RT} \\ \dot{\varepsilon} &= -\gamma\varepsilon - \gamma\eta_{vk} \frac{n_e}{2} V_d \frac{p_{\text{cal}}}{V_{IM}} + \frac{\gamma RT}{V_{IM}} m_{th} + \gamma^2 p_{\text{cal}} \\ \eta_{ve} &= \frac{2RTm_e}{n_e V_d p_{\text{cal}}}. \end{aligned} \tag{14}$$

For vehicle implementation, each of the three differential equations above needs to be discretized. If the differential equation is of the general form $\dot{x}=f(x,u)$, then the discrete updates take the form $x(k+1)=x(k)+\Delta f(x(k),u(k))$, where $\Delta$ is the sampling period and k is the sample number.

Figure 3:
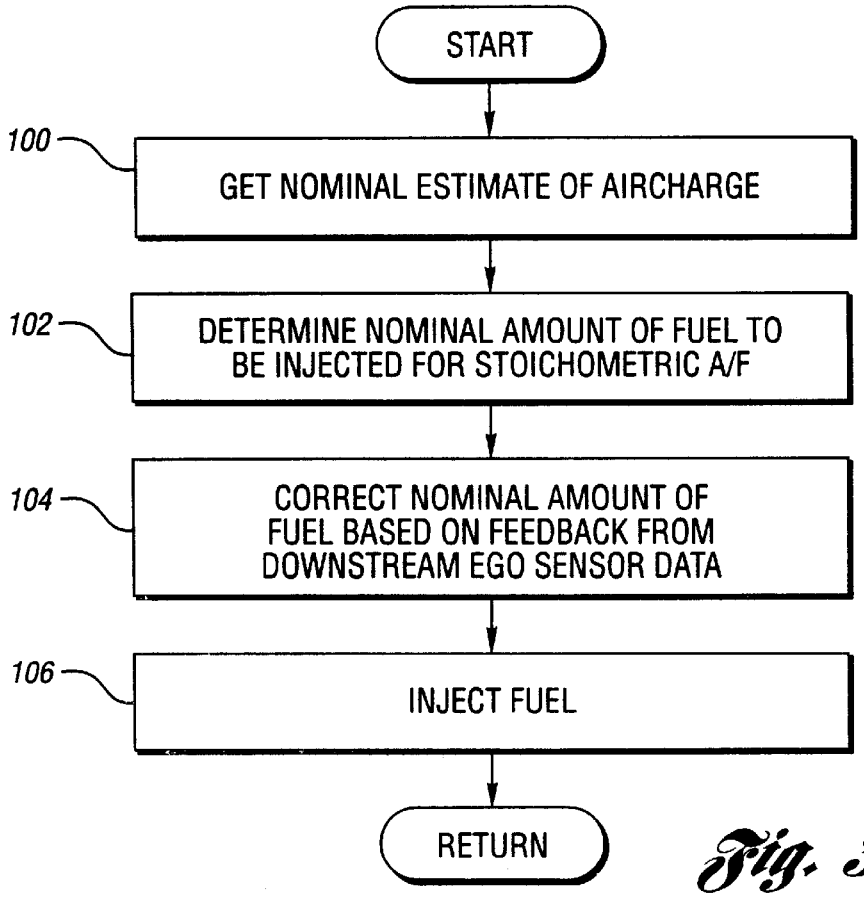
FIG. 3 is a flowchart of a convention fuel control method.

Referring now to FIG. 3, an overall flowchart of a fuel control method includes in block 100 the step of estimating the air charge which will be described in greater detail in FIG. 4. From the air charge estimate, a nominal amount of fuel to be injected is determined in block 102. In block 104 the nominal amount of fuel determined in block 102 is corrected based on data from the downstream EGO sensor and at block 106 the fuel is injected.

Figure 4:
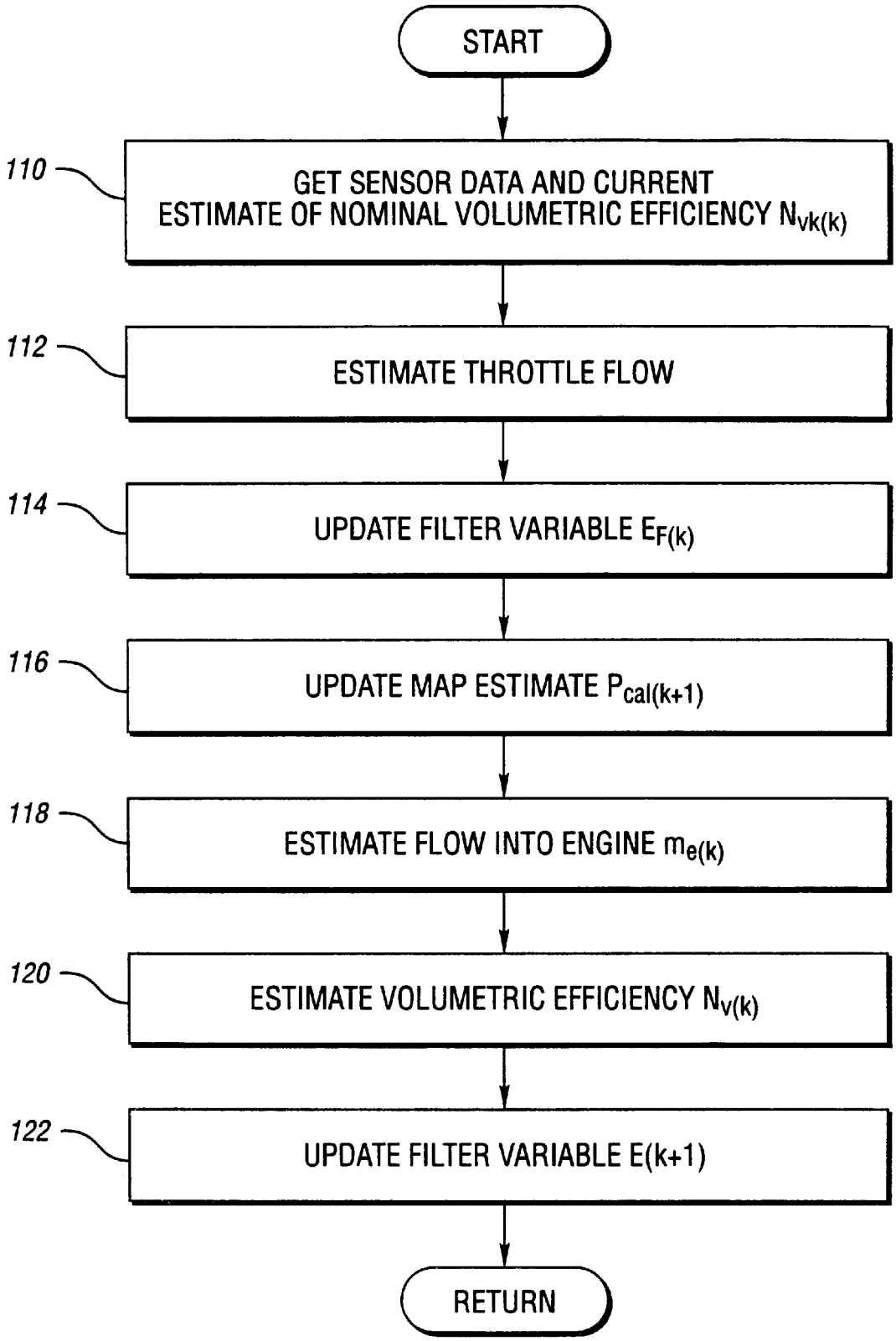
FIG. 4 is a flowchart of the air charge estimation method of the present invention.

Referring to FIG. 4, the air charge estimation method provided by the present invention is shown in greater detail. At block 110, a current estimate of nominal volumetric efficiency is read as well as sensor data including a current estimate or measurement of intake manifold temperature, engine speed, MAF, MAP, and sampling rate. Throttle flow is estimated at block 112 using MAF sensor measurement and throttle flow filter variable $\in_f$ as follows:

$$m_{th}(k)=\tau_{MAF}\cdot(\gamma_f\cdot m_{MAF}(k)-\epsilon_f(k)) \tag{15}$$

The filter variable $\in_f$ is updated in block 114 as follows:

$$\varepsilon_f(k+1)=\varepsilon_f(k)+\Delta-\left(-\gamma_f\varepsilon_f(k)-\frac{\gamma_f}{\tau_{MAF}}\cdot m_{MAF}(k)+\gamma_f^2 m_{MAF}(k)\right) \tag{16}$$

At block 116, the MAP estimate is updated using flow rate estimates in and out of the manifold and the difference between the current pressure estimate and the actual intake manifold pressure measurement, as expressed in the following equation:

$$p_{\text{cal}}(k+1)= \tag{17}$$
$$p_{\text{cal}}(k)+\Delta\cdot\left(\frac{RT(k)}{V_{IM}}\cdot(m_{th}(k)-m_e(k))-\gamma_p(p_{\text{cal}}(k)-p_{MAP}(k)\right)$$

At block 118, air flow into the engine cylinders is estimated from nominal volumetric efficiency estimates and a correction term formed from an intake manifold pressure estimate and cylinder flow filter variable $\in$ in accordance with the following:

$$m_e(k)=\eta_{vk}(k)\frac{n_e(k)}{2}V_d\frac{p_{\text{cal}}(k)}{RT(k)}+(\varepsilon(k)-\gamma_p p_{\text{cal}}(k))\frac{V_{IM}}{RT(k)} \tag{18}$$

In block 120, the volumetric efficiency is estimated as the sum of the nominal calibration of the volumetric efficiency and a correction term provided by the observer as indicated in the following equation:

$$\eta_{vk}(k)=\frac{2RT(k)m_e(k)}{n_e(k)V_d p_{\text{cal}}(k)} \tag{19}$$

At block 122, the filter variable $\in$ is updated in accordance with the following equation:

$$\varepsilon(k+1)=\varepsilon(k)+ \tag{20}$$
$$\Delta\cdot\left(-\gamma\varepsilon(k)-\gamma\eta_{vk}(k)\frac{n_e(k)}{2}V_d\frac{p_{\text{cal}}(k)}{V_{IM}}+\gamma\frac{RT(k)}{V_{IM}}m_{th}(k)+\gamma^2 p_{\text{cal}}(k)\right)$$

One of benefits for our improved air-charge estimation algorithm is believed to be for SI engines with variable valve timing and electronic throttle, or for diesel engines during acceleration (when EGR valve is closed). The algorithms are applicable to other SI and diesel engine configurations without an external EGR valve or in regimes when the external EGR valve is closed.

By comparing an SI engine configuration with a diesel engine configuration, it is easily seen that these configurations, inasmuch as the estimation of the flow into the engine cylinders is concerned, are analogous. For example, the flow through the throttle in an SI engine, $m_{th}$, plays an analogous role to the flow through the compressor, $m_{comp}$, in a diesel engine configuration. Consequently, while only one configuration has been considered in detail, that of an SI engine, it will be understood that the results apply equally to a diesel engine configuration during a tip-in when the EGR valve is closed.

While the best mode for carrying out the invention has been described in detail, those familiar with the art to which this invention relates will recognize various alternative designs and embodiments for practicing the invention as defined by the following claims.

What is claimed:

1. A method of estimating air flow into an engine comprising a sequence of the steps of:

measuring the mass air flow through the engine throttle with a mass air flow sensor (MAF);

measuring the pressure in the engine intake manifold with a pressure sensor (MAP);

estimating the flow through the throttle based on the signal from the MAF sensor and compensating for the MAF sensor dynamics;

estimating the intake manifold pressure based on the signals from the MAP and MAF sensors and filtering the noise and periodic oscillations at engine firing frequency contained in the MAP and the MAF sensor signals; and estimating the volumetric efficiency and the air flow into the engine using a differential type algorithm based on the estimates of intake manifold pressure and throttle flow.

2. A system for estimating air flow into an engine comprising:

a mass air flow (MAF) sensor;

a first observer for estimating the flow through the throttle based on the signal from the MAF sensor and for compensating for the MAF sensor dynamics;

a manifold absolute pressure (MAP) sensor;

a second observer for estimating the intake manifold pressure based on the signal from the MAP sensor and for filtering the noise and periodic oscillations at engine firing frequency contained in the MAP sensor signal and the MAF sensor signals;

a third observer for estimating the volumetric efficiency and providing an estimate of the air flow into the engine based on the estimates provided by said first and second observers.

3. The system of claim 2 wherein the first observer include means for estimating throttle flow as a weighted sum of the MAF sensor measurement and a first filter variable.

4. The system of claim 3 wherein the first filter variable is dynamically updated using its past values and MAF sensor readings.

5. The system of claim 2 wherein the first observer is provided by a differential type algorithm derived on the basis of a MAF sensor model and known MAF sensor time constant.

6. The system of claim 2 wherein the second observer includes an intake manifold pressure model based on the ideal gas law corrected with a difference between estimated and measured pressures multiplied by a gain.

7. The system of claim 2 wherein the second observer uses estimates of the throttle flow provided by the first observer and estimates of the cylinder flow provided by the third observer.

8. The system of claim 7 wherein the third observer calculates the mass air flow into the engine based on an on-line estimation of volumetric efficiency using a differential type algorithm.

9. The system of claim 8 wherein the volumetric efficiency is modeled as a sum of an initial calibration and an estimated correction error and expressed as:

$$\eta_v = \eta_{vk} + \Delta\eta_v.$$

10. The system of claim 9 wherein the estimated volumetric efficiency correction is provided as a weighted sum of a second filter variable and intake manifold pressure estimate.

11. The system of claim 10 wherein the second filter variable is dynamically updated using its past value, estimate of the throttle flow and estimate of intake manifold pressure.

12. The system of claim 11 wherein the second filter variable is dynamically updated as per equation:

$$\varepsilon(k+1) = \varepsilon(k) + \Delta\cdot\left(-\gamma\varepsilon(k) - \gamma\eta_{vk}(k)\frac{n_e(k)}{2}V_d\frac{p_{cal}(k)}{V_{IM}} + \gamma\frac{RT(k)}{V_{IM}}m_{th}(k) + \gamma^2 p_{cal}(k)\right).$$

13. The system of claim 12 wherein the engine is a spark ignition engine.

14. The system of claim 12 wherein the engine is a diesel engine.

15. The system of claim 2 wherein the first observer has the following form:

$$\dot{\varepsilon}_f = -\gamma_f\varepsilon_f\frac{\gamma_f}{\tau}m_{MAF} + \gamma_f^2 m_{MAF},$$

$$m_{th} = \tau_{MAF}(\gamma_f m_{MAF} - \varepsilon_f).$$

16. The system of claim 15 wherein the second observer has the following form:

$$\dot{p}_{cal} = \frac{RT}{V_{IM}}(m_{th} - m_e) - \gamma_p(p_{cal} - p_{MAP}).$$

17. The system of claim 16 wherein the third observer has the following form:

$$m_e = \eta_{vk}\frac{n_e}{2}V_d\frac{p_{cal}}{RT} + (\varepsilon - \gamma_p p_{cal})\frac{V_{IM}}{RT},$$

where $\in$ is adjusted as follows:

$$\dot{\varepsilon} = -\gamma\varepsilon - \gamma\eta_{vk}\frac{n_e}{2}V_d\frac{p_{cal}}{V_{IM}}m_{th} + \gamma^2 p_{cal}.$$

18. A system for controlling operation of a fuel control system having fuel injector means for supplying fuel to an engine, said fuel injector means being responsive to a fuel control signal based on air flow into the engine intake manifold comprising;

sensor means for sensing conditions of operation of said engine and for producing data indicative thereof, said sensor means including a mass air flow (MAF) sensor for measuring air flow into the intake manifold and a manifold absolute pressure (MAP) sensor;

observer means for generating real time estimates of air charge entering the engine based on data from said sensors;

said observer means compensating for MAF sensor dynamics, estimating the intake manifold pressure based on the ideal gas law and data from said MAP sensor and filtering noise and periodic oscillations at engine firing frequency contained in the data from said MAF and MAP sensors, and estimating the volumetric efficiency and the air flow into the engine using a speed density equation wherein the volumetric efficiency is estimated on line using a differential type algorithm.

19. An article of manufacture comprising:

a computer storage medium having a computer program encoded therein for estimating air-charge for an engine, said computer storage medium comprising code for measuring the mass air flow through the engine throttle with a mass air flow sensor (MAF);

code for measuring the pressure in the engine intake manifold with a pressure sensor (MAP);

code for estimating the flow through the throttle based on the signal from the MAF sensor and compensating for the MAF sensor dynamics;

code for estimating the intake manifold pressure based on the signal from the MAP sensor and filtering the noise, and periodic oscillations at engine firing frequency, contained in the MAP sensor signal and the MAF sensor signals; and code for estimating the volumetric efficiency and providing an estimate of the air flow into the engine.

20. A method for estimating cylinder air-charge in an internal combustion engine, the engine having an intake manifold coupled upstream of it, the manifold having a manifold airflow (MAF) and a manifold absolute pressure (MAP) sensors disposed inside it, the method comprising:

reading a MAF sensor signal and filtering said reading to compensate for MAF sensor dynamics;

estimating air flow through the throttle based on said filtered MAF sensor reading;

reading a MAP sensor signal and filtering said reading to compensate for the noise;

estimating intake manifold pressure based on said filtered MAP sensor reading and said filtered MAF sensor reading; and estimating cylinder air-charge based on said estimated engine airflow and said estimated intake manifold pressure.

21. The method defined in claim 20 wherein said step of estimating cylinder air-charge is further based on an on-line estimation of volumetric efficiency using a differential type algorithm.

22. The method of claim 21 wherein the volumetric efficiency is modeled as a sum of an initial calibration and an estimated correction error and expressed as:

$$\eta_v = \eta_{vk} + \Delta\eta_v.$$

23. The method of claim 20 wherein the air flow estimating step is represented by the following equations:

$$\dot{\varepsilon}_f = -\gamma_f\varepsilon_f\frac{\gamma_f}{\tau}m_{MAF} + \gamma_f^2 m_{MAF},$$

$$m_{th} = \tau_{MAF}(\gamma_f m_{MAF} - \varepsilon_f).$$

24. The method of claim 23 wherein the intake manifold pressure estimating step is represented by the following equation:

$$\dot{p}_{cal} = \frac{RT}{V_{IM}}(m_{th} - m_e) - \gamma_p(p_{cal} - p_{MAP}).$$

25. The method of claim 24 wherein the air-charge estimating step is represented by the following equations:

$$m_e = \eta_{vk}\frac{n_e}{2}V_d\frac{p_{cal}}{RT} + (\varepsilon - \gamma_p p_{cal})\frac{V_{IM}}{RT}.$$

where $\in$ is adjusted as follows:

$$\dot{\varepsilon} = -\gamma\varepsilon - \gamma\eta_{vk}\frac{n_e}{2}V_d\frac{p_{cal}}{V_{IM}}m_{th} + \gamma^2 p_{cal}.$$

26. A system for estimating cylinder air-charge in an internal combustion engine, the system comprising:

a manifold airflow (MAF) sensor;

a manifold absolute pressure (MAP) sensor;

a controller for filtering a MAF sensor signal to obtain a first estimate of air flow into the engine, said controller further filtering a MAP sensor signal, calculating a second estimate of intake manifold pressure based on said filtered MAP sensor signal and said first estimate, and calculating a third estimate of cylinder air-charge based on said first estimate and said second estimate.

* * * * *